US009187296B2

(12) United States Patent
Walker et al.

(10) Patent No.: US 9,187,296 B2
(45) **Date of Patent: *Nov. 17, 2015**

(54) CONNECTION SYSTEM FOR CRANE COLUMN SEGMENTS

(71) Applicant: Manitowoc Crane Companies, LLC, Manitowoc, WI (US)

(72) Inventors: Robert J. Walker, Manitowoc, WI (US); Feng Pan, New Berlin, WI (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 2 days.

This patent is subject to a terminal disclaimer.

(21) Appl. No.: 13/912,884

(22) Filed: Jun. 7, 2013

(65) Prior Publication Data

US 2013/0270208 A1 Oct. 17, 2013

Related U.S. Application Data

(60) Continuation of application No. 13/154,236, filed on Jun. 6, 2011, now Pat. No. 8,534,474, which is a division of application No. 12/273,310, filed on Nov. 18, 2008, now Pat. No. 7,954,657.

(60) Provisional application No. 61/990,977, filed on Nov. 29, 2007.

(51) Int. Cl.
*B66C 23/70* (2006.01)

(52) U.S. Cl.
CPC ..... *B66C 23/70* (2013.01); *Y10T 29/4978* (2015.01); *Y10T 29/49947* (2015.01); *Y10T 403/18* (2015.01); *Y10T 403/553* (2015.01); *Y10T 403/7075* (2015.01)

(58) Field of Classification Search
CPC ..... B66C 23/62; B66C 23/64; B66C 23/66; B66C 23/70
USPC ..... 212/177, 347; 52/650.1, 651.05, 848; 403/294, 378
See application file for complete search history.

(56) References Cited

U.S. PATENT DOCUMENTS 2,529,454 A 11/1950 Marcantonio
2,975,910 A 3/1961 Conrad (Continued)

FOREIGN PATENT DOCUMENTS

DE 3706301 C1 10/1987
DE 4402005 A1 7/1995

(Continued)

OTHER PUBLICATIONS

Brochure, "HC-238, 125-Ton Truck Crane" 3 pages (undated but prior to Nov. 29, 2007).

(Continued)

*Primary Examiner* — Sang Kim
*Assistant Examiner* — Juan Campos, Jr.
(74) *Attorney, Agent, or Firm* — Craig Buschmann; Brinks Gilson & Lione

(57) ABSTRACT

A crane column segment connection system includes first and second column segments with a connector on the second end of the first segment mating with a connector on the first end of the second segment. The connectors each include at least one extension having a through-hole. The through-holes have an axis and are positioned in the extensions such that all through-holes of mating connectors are aligned when the column segments are aligned. In one aspect, the connectors include alignment surfaces cooperating such that when the first and second connectors are being brought together during column assembly, the alignment surfaces guide the column segments in two dimensions within a plane transverse to the axis of the through-holes into a relative position such that the through-holes through the extensions in the connectors are aligned.

19 Claims, 8 Drawing Sheets

(56) References Cited

U.S. PATENT DOCUMENTS

| | | | |
|---|---|---|---|
| 3,085,695 | A | 4/1963 | Miller |
| 3,430,778 | A | 3/1969 | Brown |
| 3,955,684 | A | 5/1976 | Novotny |
| 3,977,530 | A | 8/1976 | Helm et al. |
| 4,081,081 | A | 3/1978 | Morrow, Sr. et al. |
| 4,273,244 | A | 6/1981 | Jensen et al. |
| 4,582,205 | A | 4/1986 | Berger et al. |
| 5,082,128 | A | 1/1992 | Franzen et al. |
| 5,199,586 | A | 4/1993 | Pech et al. |
| 5,443,169 | A | 8/1995 | Pagel et al. |
| 5,484,069 | A | 1/1996 | Lanning |
| 6,062,405 | A | 5/2000 | Pech et al. |
| 6,089,388 | A | 7/2000 | Willim |
| 6,131,751 | A | 10/2000 | Pech et al. |
| 6,213,318 | B1 | 4/2001 | Walker |
| 6,481,202 | B1 | 11/2002 | Zuehlke et al. |
| 6,588,521 | B1 | 7/2003 | Porubcansky et al. |
| 6,702,132 | B1 | 3/2004 | Moore et al. |
| 7,007,764 | B2 | 3/2006 | Smith et al. |
| 7,270,243 | B2 | 9/2007 | Diehl |
| 7,503,623 | B2 | 3/2009 | Favaretto |
| 7,546,928 | B2 | 6/2009 | Pech et al. |
| 7,565,982 | B2 | 7/2009 | Kurotsu et al. |
| 7,762,412 | B2 | 7/2010 | Porubcansky |
| 7,954,657 | B2 | 6/2011 | Holly et al. |
| 7,967,158 | B2 | 6/2011 | Pech et al. |
| 8,534,474 | B2 | 9/2013 | Holly et al. |
| 8,622,228 | B2 | 1/2014 | Mentink et al. |
| 8,739,988 | B2 | 6/2014 | Walker |
| 2002/0053551 | A1 | 5/2002 | Koster et al. |
| 2006/0065616 | A1 | 3/2006 | Diehl |
| 2007/0256999 | A1 | 11/2007 | Kurotsu et al. |
| 2008/0099421 | A1 | 5/2008 | Pech et al. |
| 2008/0173605 | A1 | 7/2008 | Willim |
| 2008/0203045 | A1 | 8/2008 | Pech et al. |
| 2008/0264887 | A1 | 10/2008 | Porubcansky |
| 2010/0260539 | A1 | 10/2010 | Sakamoto et al. |
| 2010/0326004 | A1 | 12/2010 | Daas et al. |
| 2011/0233165 | A1 | 9/2011 | Holly et al. |
| 2011/0284490 | A1 | 11/2011 | Liu et al. |
| 2012/0067840 | A1 | 3/2012 | Walker |
| 2012/0175333 | A1 | 7/2012 | Pech et al. |
| 2013/0270208 | A1 | 10/2013 | Walker et al. |

FOREIGN PATENT DOCUMENTS

| | | | |
|---|---|---|---|
| EP | 0376417 | A1 | 7/1990 |
| EP | 0533323 | A1 | 3/1993 |
| EP | 1205421 | A1 | 5/2002 |
| EP | 1468955 | A1 | 10/2004 |
| EP | 2431322 | A1 | 3/2012 |
| FR | 2519620 | A1 | 7/1983 |
| JP | 1988-212692 | A | 5/1988 |
| JP | 1990-225294 | A | 7/1990 |
| JP | 09156882 | A | 6/1997 |
| JP | 2004-189496 | A | 8/2004 |
| NL | 1035078 | C1 | 3/2008 |
| SU | 1801180 | A3 | 3/1993 |

OTHER PUBLICATIONS

Brochure for Manitowoc 4100 Crane, 1 page (undated but prior to Sep. 16, 2009).

European Search Report for related European Application No. 13197111.1, dated Mar. 12, 2014 (5 pages).

European Search Report for related European Application No. 14184310.2, dated Nov. 27, 2014 (5 pages).

Liebherr LR11350—four photographs of load, boom and mast hoist drum mounting (undated but prior to Sep. 16, 2009).

Liebherr LR13000 Welded Boom Connector (Feb. 14, 2011).

Mammoet Connector PTC120DS Boom Photos2 (May 18, 2011).

Manitowoc 16000—three photographs of load and mast hoist drums (undated but prior to Sep. 16, 2009).

Pages from "LR1600/2 Crawler Crane—Technical Data," Liebherr, pp. 1-10 (undated but prior to Sep. 16, 2009).

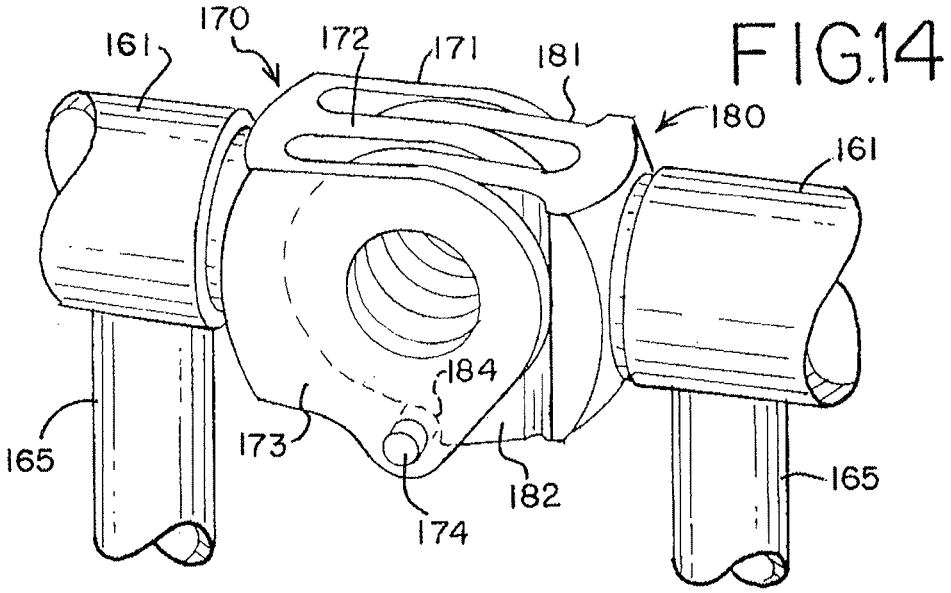
FIG.14
FIG.15
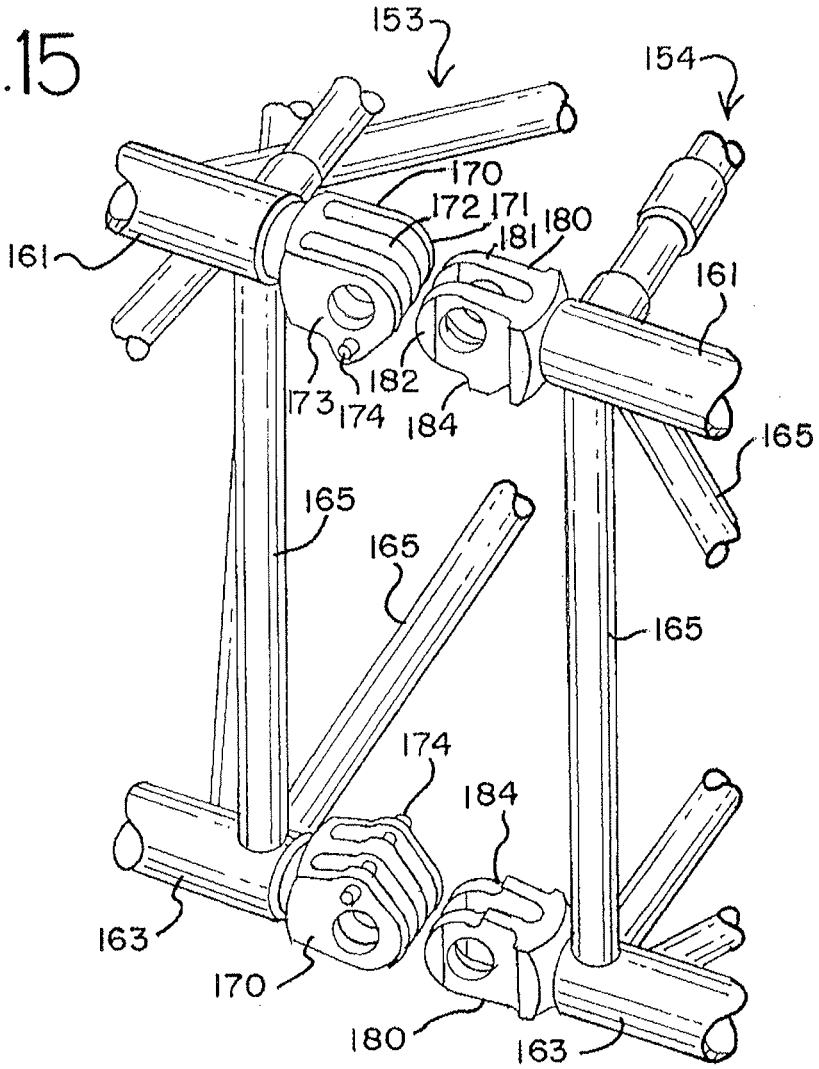

CONNECTION SYSTEM FOR CRANE COLUMN SEGMENTS

REFERENCE TO EARLIER FILED APPLICATIONS

The present application is a continuation of application Ser. No. 13/154,236, filed Jun. 6, 2011, which is a divisional of application Ser. No. 12/273,310, filed Nov. 18, 2008, and which issued on Jun. 7, 2011 as U.S. Pat. No. 7,954,657, which in turns claims the benefit of the filing date under 35 U.S.C. §119(e) of Provisional U.S. Patent Application Ser. No. 60/990,977, filed Nov. 29, 2007; both of which are hereby incorporated by reference in their entirety.

BACKGROUND OF THE INVENTION

The present invention relates to lift cranes, and more particularly to connection systems for aligning sectional boom members for cranes and the like.

Large capacity lift cranes typically have elongate load supporting boom structures comprised of sectional boom members secured in end-to-end abutting relationship. Predominantly, each of the sectional boom members is made of a plurality of chords and lacing or lattice elements. The terminal end portions of each chord are generally provided with connectors of one form or another to secure abutting boom segments together and to carry compressive loads between abutting chords. Typical connectors comprise male and female lugs secured by a pin carrying compressive loads in double shear.

An example 220 foot boom may be made of a 40 foot boom butt pivotally mounted to the crane upper works, a 30 foot boom top equipped with sheaves and rigging for lifting and supporting loads, with five sectional boom members in between: one 10 feet in length, one 20 feet in length and three 40 feet in length. Such an example boom has six boom segment connections. Typically each segment has four chords, and hence four connectors, making a total of 24 connectors that must be aligned and pinned to assemble the boom.

Large capacity cranes require very large boom cross sections. As a result, even when the boom segments are laying flat on the ground, the pin connectors between the top chords are typically eight feet or higher off the ground. The rigging personnel must either move a step ladder to each pin location or stand and walk along the top of the boom to reach the top connectors.

A 40 foot long sectional boom member may weight over 5,000 lbs. Thus, an assist crane is required to lift the boom member. One rigger usually then holds the suspended boom segment in general alignment while a second rigger uses a large hammer (10 or 15 lbs.) to manually drive the pin, which typically has a long taper, into position. The pins connecting the boom segments are generally used to carry the compressive loads between chords. As a result, the pins have a tight fit, further increasing the difficulty in assembling the boom. As such, it may take three men (a crane operator and two riggers) four or more hours to assemble the example 220 foot boom. Where the crane is moved frequently, the costs to assemble and disassemble the boom may exceed the cost to lift and position the load for which the crane is used.

To carry very high loads for a high capacity crane, a typical single male lug sandwiched between two female lugs, giving a double shear connection, requires a very large pin diameter to carry the compressive loads, requiring the connectors to be very large. There are known connectors with three female lugs and two male lugs, but there is no provision for these types of boom connections to provide for any self-alignment or rotatable connection (where the boom segments can be initially connected when not axially aligned and then swung into a position where the reminder of the connections can be made) between the boom sections as the sections are assembled.

Thus, an easy, quick-connect system for boom segments that allows faster connection of the boom segments and an initial connection from a position where the boom segments are not in axial alignment would be a great improvement.

BRIEF SUMMARY

An improved connection system for boom segments has been invented. With the invention, boom segments have connectors that include alignment surfaces and/or stop surfaces that allow the connectors to be easily aligned for insertion of the pin, and allow the boom segments to be initially connected and then rotated into a final position where the remainder of the connections between segments can be made.

In a first aspect, the invention is a crane having a boom with a boom segment connection system, the crane having an upper works rotatably mounted on a lower works, the upper works including a load hoist winch, the boom comprising:

a) at least a first and second boom segment each with a longitudinal axis and a first and second end, the second end of the first segment being coupled to the first end of the second segment;

b) at least one first connector on the second end of the first segment respectively mating with at least one second connector on the first end of the second segment;

c) the first and second connectors each comprising at least one extension having an aperture there through, and the aperture having an axis perpendicular to the longitudinal axis and positioned in the extensions such that all apertures of mating first and second connectors are aligned when the boom segments are aligned;

d) the at least one first connector comprising a first alignment surface and the at least one second connector comprising a second alignment surface;

e) the first and second alignment surfaces cooperating such that when the first and second connectors are being brought together during boom assembly, the alignment surfaces urge the boom segments into a relative position such that the apertures through the extensions in the connectors are aligned sufficiently such that a tapered main pin can be inserted through the apertures of the extensions in the first and second mating connectors even if the boom segments are not axially aligned.

In a second aspect, the invention is a crane boom segment comprising:

a) at least three chords, with interlacing elements connecting the chords into a fixed, parallel relationship forming a boom segment; each of the chords, and the boom segment, having a first end and a second end; at least one of the at least three chords being present in a first longitudinal portion of the boom segment and the remainder of the at least three chords being present in a second longitudinal portion of the boom segment;

b) a connector on each of the first and second ends of each of the chords; half of the connectors being of a first type and having extensions and half of the connectors being of a second type and having extensions, each of the connectors including a stop surface;

c) the extensions having an aperture there through sized to receive a main pin, the extensions and apertures being positioned on their respective connectors such that when the second end of the boom segment is in an aligned position with and coupled to the first end of an identical boom segment, with connectors on the two boom segments coupled together, the extensions of the coupled connectors overlap one another and the apertures are aligned such that the main pins may be inserted through the apertures to secure the connector of the second end of the boom segment to the connector of the first end of the identical boom segment; and d) the placement of the stop surfaces on the connectors being such that, when the identical boom segment is positioned such that a main pin can be inserted through the apertures in the extensions of the connectors of the remainder of the chords on the second longitudinal portion of the boom segments, the stop surfaces cooperate to align the apertures in the extensions of their respective connectors when the stop surfaces contact one another.

In another aspect, the invention is a mated connection between two sectional boom members comprising:

a) a first connecter affixed to an end of a first sectional boom member and a second connector affixed to an end of a second sectional boom member;

b) each first and second connector having a first and second set of extensions, with each extension having an aperture there through sized to receive a pin;

c) each connector also comprising a compressive load bearing surface positioned between the first set and second sets of extensions, the compressive load bearing surface of the first connector being in face-to-face relationship with the compressive load bearing surface of the second connector; and d) a first pin passing through the apertures of the first set of extensions of the first connector and the first set of extensions of the second connector, and a second pin passing through the apertures of the second set of extensions of the first connector and the second set of extensions of the second connector.

In still another aspect, the invention is a mated connection between two sectional boom members comprising:

a) a first connecter affixed to an end of a first sectional boom member, the connector comprising a plurality of extensions each having an aperture there through, and a guide pin captured in an additional aperture though the extensions;

b) a second connector affixed to an end of a second sectional boom member, the second connector also having a plurality of extensions each having an aperture there through, the extensions of the first connector being interleaved with the extensions of the second connector, the second connector further having a stop surface formed on the outside of the extensions; and c) a main pin through the apertures of the interleaved extensions securing the first and second connectors in a pivotal relationship, the stop surface and the guide pin being in contact with one another when the boom segments are in axial alignment.

In another aspect, the invention is a method of connecting first and second segments of a lift crane boom, the boom segments each comprising a longitudinal axis and four chords, with each of the chords having a connector on each end thereof, the method comprising:

a) bringing the two boom segments together such that a first alignment surface on two connectors on the first boom segment contact a second alignment surface on two respective connectors on the second boom segment to form two pairs of engaged connectors, but the longitudinal axes of the two segments are not aligned and the remaining connectors on each segment are not coupled, the first and second alignment surfaces cooperating to generally align apertures in the connectors;

b) fastening each of the engaged connectors together with a pin, providing a pivoting connection;

c) pivoting the two segments with respect to each other about the pivoting connection until a stop surface on the non-coupled connectors of the first segment contacts a stop surface on the non-coupled connectors of the second segment; and d) pinning the previously non-coupled connectors to their respective mating connector.

In yet another aspect, the invention is a crane having an upper works rotatably mounted on a lower works, the upper works including at least one column, the column comprising: a) at least a first and second column segment each with a longitudinal axis and a first and second end, the second end of the first segment being coupled to the first end of the second segment; b) at least one first connector on the second end of the first segment respectively mating with at least one second connector on the first end of the second segment; c) the first and second connectors each comprising at least one extension having a through-hole there through, and the through-hole having an axis perpendicular to said longitudinal axis and positioned in the extensions such that all through-holes of mating first and second connectors are aligned when the column segments are aligned; d) the at least one first connector comprising a first alignment surface comprising a rounded outer surface on a distal end of the extension of the first connector, and the at least one second connector comprising a second alignment surface comprising a concave pocket adjacent a base of the extension on the second connector; and e) the first and second alignment surfaces cooperating such that when the first and second connectors are being brought together during column assembly, said alignment surfaces guide the column segments into alignment such that when the first and second alignment surfaces on both the first and second connectors are fully engaged, the through-holes through the extensions in the connectors are aligned such that a tapered main pin can be inserted through the through-holes of all extensions in the first and second mating connectors.

In still another aspect, the invention is a mated connection between two sectional column members comprising: a) a first connecter affixed to an end of a first sectional column member and a second connector affixed to an end of a second sectional column member; b) each first and second connector having at least one extension, with each extension having a through-hole there through sized to receive a pin; c) a pin passing through the through-hole of each extension of the first connector and the through-hole of each extension of the second connector, and d) wherein the extension on the first connector comprises a rounded first alignment surfaces on its distal ends; and the second connector comprises a pocket adjacent a base of the extension on the second connector that provides second alignment surface, the first and second alignment surfaces being configured such that the connectors can be brought together from an angled relationship and the first and second alignment surfaces cooperate to align the through-holes in each extension on the first connector with the through-holes of each extension on the second connector sufficient that the pin can be inserted through the through-holes.

In another aspect, the invention is a crane column segment comprising: a) at least three chords, with interlacing elements connecting the chords into a fixed, parallel relationship forming a column segment; each of the chords, and the column segment, having a first end and a second end; at least one of the at least three chords being present in a first longitudinal portion of the column segment and the remainder of the at least three chords being present in a second longitudinal portion of the column segment; b) a connector on each of the first and second ends of each of the chords; half of all of the connectors on the column segment being of a first type and having at least one extension and half of all of the connectors on the column segment being of a second type and having at least one extension; and c) the extensions having a through-hole there through sized to receive a main pin, the extensions and through-holes being positioned on their respective connectors such that when the second end of the column segment is in an aligned position with and coupled to the first end of an identical column segment, with connectors on the two column segments coupled together, the extensions of the coupled connectors overlap one another and the through-holes are aligned such that the main pins may be inserted through the through-holes to secure the connector of the second end of the column segment to the connector of the first end of the identical column segment; the first type of connectors comprising a first alignment surface comprising a rounded outer surface on a distal end of the extension of the first type of connector and the second type of connector comprising a second alignment surface comprising a pocket adjacent a base of the extension on the second type of connector.

In a further aspect, the invention is a method of connecting first and second segments of a lift crane column, the column segments each comprising a longitudinal axis, two top chords and two bottom chords, with each of the chords having a connector on each end thereof, each connector comprising at least one extension having a through-hole there through, and the through-hole having an axis perpendicular to said longitudinal axis and positioned in the extensions such that all through-holes of mating connectors are aligned when the column segments are aligned; with at least one first connector on one of the ends of the chords of the first segment comprising a first alignment surface comprising a rounded outer surface on a distal end of the extension of the first connector, and at least one second connector on one of the ends of the chords of the second segment comprising a second alignment surface comprising a concave pocket adjacent a base of the extension on the second connector, the method comprising: a) bringing the two column segments together such that the first alignment surface contacts the second alignment surface to form a pair of engaged connectors, the first and second alignment surfaces cooperating to generally align through-holes in the first and second connectors even if the longitudinal axes of the two segments are not aligned and the remaining connectors on each segment are not coupled; b) placing a tapered pin through the through-holes of the extensions of the first and second connectors, providing a pivoting connection; c) pivoting the two segments with respect to each other about the pivoting connection until a stop surface on the non-coupled connectors of the first segment contacts a stop surface on the non-coupled connectors of the second segment; and d) pinning the previously non-coupled connectors to their respective mating connector.

With the preferred embodiment of the invention, large sections of a lift crane boom or other column member on the crane can be assembled with a faster set-up time because the through-holes through which the pins have to be driven are aligned when the connectors are brought into position and the alignment surfaces are brought into contact. Further, if the segments need to be connected from a non-aligned positioned, once one set of pins is in place, the sections can be pivoted into and will automatically stop in an aligned configuration with the through-holes on the remaining connectors already lined up. With the preferred embodiment of the invention, this will be true whether the top or bottom pins are placed first.

These and other advantages of the invention, as well as the invention itself, will best be understood in view of the drawings, a brief description of which is as follows.

BRIEF DESCRIPTION OF THE DRAWINGS

FIG. 14 is a perspective view of a mated pair of connectors used to connect the boom segments of FIG. 12.

FIG. 15 is a perspective view of the ends of two boom segments of FIG. 12 being assembled.

DETAILED DESCRIPTION OF THE PREFERRED EMBODIMENTS

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

The preferred embodiment of the present invention relates to a high capacity mobile lift crane, other aspects of which are disclosed in U.S. Pat. No. 7,546,928 (Mobile Lift Crane With Variable Position Counterweight) and U.S. Pat. No. 7,762,412 (Mast Raising Structure And Process For High-Capacity Mobile Lift Crane), and the following United States patent applications assigned to the assignee of the present application: "Mobile Lift Crane With Variable Position Counterweight," Ser. No. 12/023,902, filed Jan. 31, 2008; "Drive Tumbler, Track Drive, And Track Connection And Tensioning System," Ser. No. 61/027,755; "Boom Hoist Transportation System And Crane Using Same", Ser. No. 61/098,632 filed on Sep. 19, 2008 and "Trunnion Transportation System, Carbody Connection System And Crane Using Same", Ser. No. 61/099,098, filed on Sep. 22, 2008. Each of these applications is hereby incorporated by reference.

For ease of reference, designation of "top," "bottom," "horizontal" and "vertical" are used herein and in the claims to refer to portions of a sectional boom in a position in which it would typically be assembled on or near the surface of the ground. These designations still apply although the boom may be raised to different angles, including a vertical position.

Figure 1:
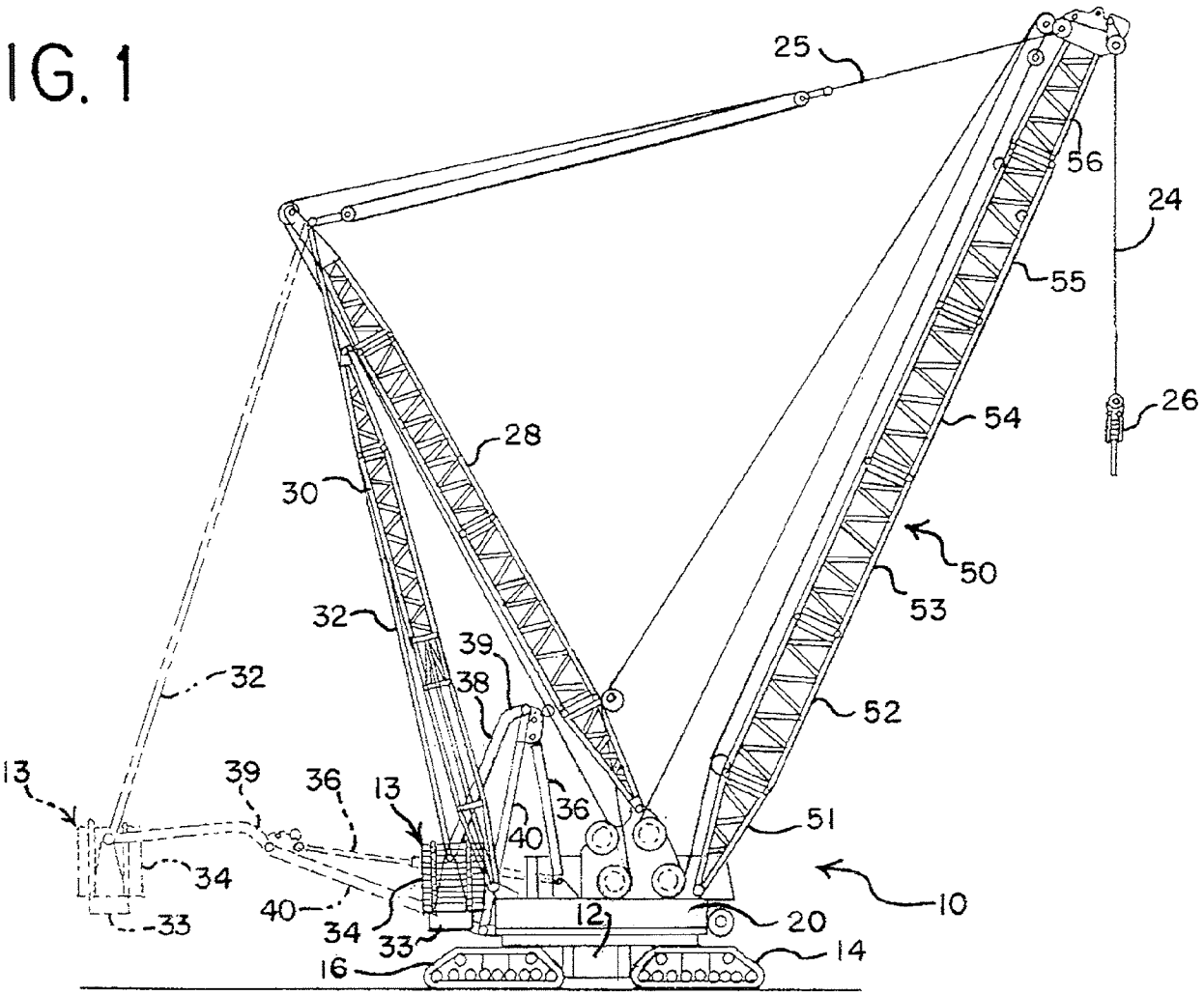
FIG. 1 is a side elevational view of a crane with a sectional boom utilizing the sectional boom connection and alignment system of the present invention.

The mobile lift crane 10, as shown in FIG. 1, includes lower works, also referred to as a carbody 12, and moveable ground engaging members in the form of crawlers 14 and 16. (There are of course two front crawlers 14 and two rear crawlers 16, only one each of which can be seen from the side view of FIG. 1.) In the crane 10, the ground engaging members could be just one set of crawlers, one crawler on each side. Of course additional crawlers than those shown, or other ground engaging members such as tires, can be used.

A rotating bed 20 is rotatably connected to the carbody 12 using a roller path, such that the rotating bed 20 can swing about an axis with respect to the ground engaging members 14, 16. The rotating bed supports a boom 50 pivotally mounted on a front portion of the rotating bed; a mast 28 mounted at its first end on the rotating bed; a backhitch 30 connected between the mast and a rear portion of the rotating bed; and a moveable counterweight unit 13 having counterweights 34 on a support member 33. The counterweights may be in the form of multiple stacks of individual counterweight members on the support member 33.

Boom hoist rigging 25 between the top of mast 28 and boom 50 is used to control the boom angle and transfers load so that the counterweight can be used to balance a load lifted by the crane. A hoist line 24 extends from the boom 50, supporting a hook 26. The rotating bed 20 may also includes other elements commonly found on a mobile lift crane, such as an operator's cab and hoist drums for the rigging 25 and hoist line 24. If desired, the boom 50 may comprise a luffing jib pivotally mounted to the top of the main boom, or other boom configurations. The backhitch 30 is connected adjacent the top of the mast 28. The backhitch 30 may comprise a lattice member designed to carry both compression and tension loads as shown in FIG. 1. In the crane 10, the mast is held at a fixed angle with respect to the rotating bed during crane operations, such as a pick, move and set operation.

The counterweight unit is moveable with respect to the rest of the rotating bed 20. In the crane embodiment depicted, the counterweight unit 13 is designed to be moved in and out with respect to the front of the crane in accordance with the invention disclosed in U.S. Pat. No. 7,546,928 entitled "Mobile Lift Crane With Variable Position Counterweight," and U.S. patent application Ser. No. 12/023,902, entitled "Mobile Lift Crane With Variable Position Counterweight." A tension member 32 connected adjacent the top of the mast supports the counterweight unit. A counterweight movement structure is connected between the rotating bed and the counterweight unit such that the counterweight unit may be moved to and held at a first position in front of the top of the mast, shown in solid lines in FIG. 1, and moved to and held at a second position rearward of the top of the mast, shown in dotted lines in FIG. 1.

In the crane 10, a hydraulic cylinder 36, pivot frame 40 and a rear arm 38 may be used to move the counterweight unit. (As with the crawlers, the rear arm 38 actually has both left and right members, only one of which can be seen in FIG. 1, the pivot frame has two side members, and the hydraulic cylinder comprises two cylinders that move in tandem. Alternatively, one larger hydraulic cylinder, or a rack and pinion structure, powered by preferably four hydraulic motors, could be used in place of the two hydraulic cylinders 36 to provide the linear actuation. Further, the pivot frame could be made as a solid plate structure, and the two rear arms 38 could be replaced by one single structure.) The pivot frame 40 is connected between the rotating bed 20 and hydraulic cylinder 36, and the rear arm 38 is connected between the pivot frame 40 and the counterweight unit. The hydraulic cylinder 36 is pivotally connected to the rotating bed 20 on a support frame which elevates the hydraulic cylinder 36 to a point so that the geometry of the cylinder 36, pivot frame 40 and rear arm 38 can move the counterweight through its entire range of motion. In this manner the cylinder 36 causes the rear arm 38 to move the counterweight unit when the cylinder is retracted and extended.

Arms 38 have an angled portion 39 at the end that connects to the pivot frame 40. This allows the arms 38 to connect directly in line with the side members of pivot frame 40. The angled portion 39 prevents the arms 38 from interfering with the side members of the pivot frame the when the counterweight is in the position shown in solid lines in FIG. 1.

The boom 50 is made of several sectional members, including a boom butt 51, boom insert segments 52, 53, 54 and 55, which may vary in number and be of different lengths, and a boom top 56. The sectional boom members 51-56 typically are comprised of multiple chords. Two embodiments of connectors for connecting the boom segments are described below. FIGS. 2-11 show a first embodiment, and FIGS. 12-21 show a second embodiment.

Each boom segment 53 and 54 has a rectangular cross section with a chord at each corner. The segments 53 and 54, which are representative and may be considered as first and second boom segments, each have a longitudinal axis 41 (FIG. 2), as well as first and second ends. The second end of the first segment 53 is coupled to the first end of the second segment 54. There are two top chords 61 and two bottom chords 63 (only one of each of which can be seen in the side views) interconnected by intermediate lacing or lattice elements 65 connecting the chords into a fixed, parallel relationship forming the boom segment. In the embodiment shown, the chord members are made of steel with a circular, tubular cross section. A horizontal plane containing the longitudinal axis 41 can be considered to divide the boom segment into first and second longitudinal portions 67 and 68, with the two top chords 61 being present in the first portion 67 and the two bottom chords 63 being present in the second longitudinal portion of the boom segment 68. These particular first and second longitudinal portions are identified for ease in explaining the invention. Of course other configurations of boom segments are possible with a differing number of chords, and different ways of designating longitudinal portions of the boom segments are possible.

Each chord member has a vertical neutral axis and a horizontal neutral axis. Compressive loads applied at the intersection of the vertical and horizontal neutral axes of a chord, or symmetrically about the horizontal and vertical neutral axes, will not induce bending moments within the chord. Thus it is preferable that connectors that are used to connect boom segments together are mounted on the boom segments at the ends of the chords such that compressive loads transmitted through the connectors are symmetrical about the neutral axes of the chords.

Figure 2:
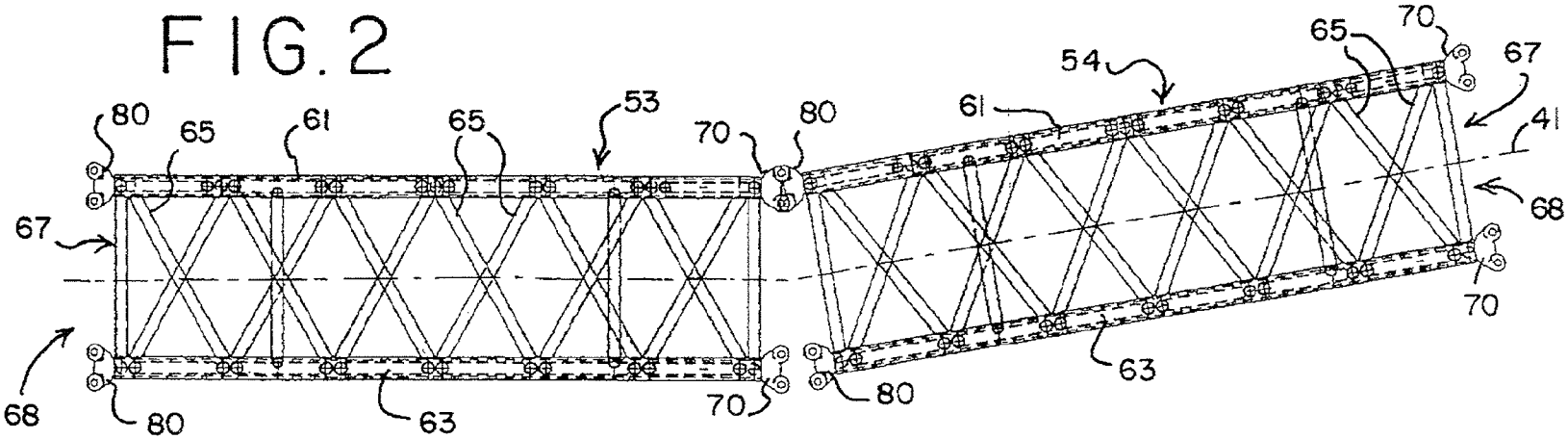
FIG. 2 is a side elevational view of two boom segments being brought together from a first position to form the boom on the crane of FIG. 1.
Figure 3:
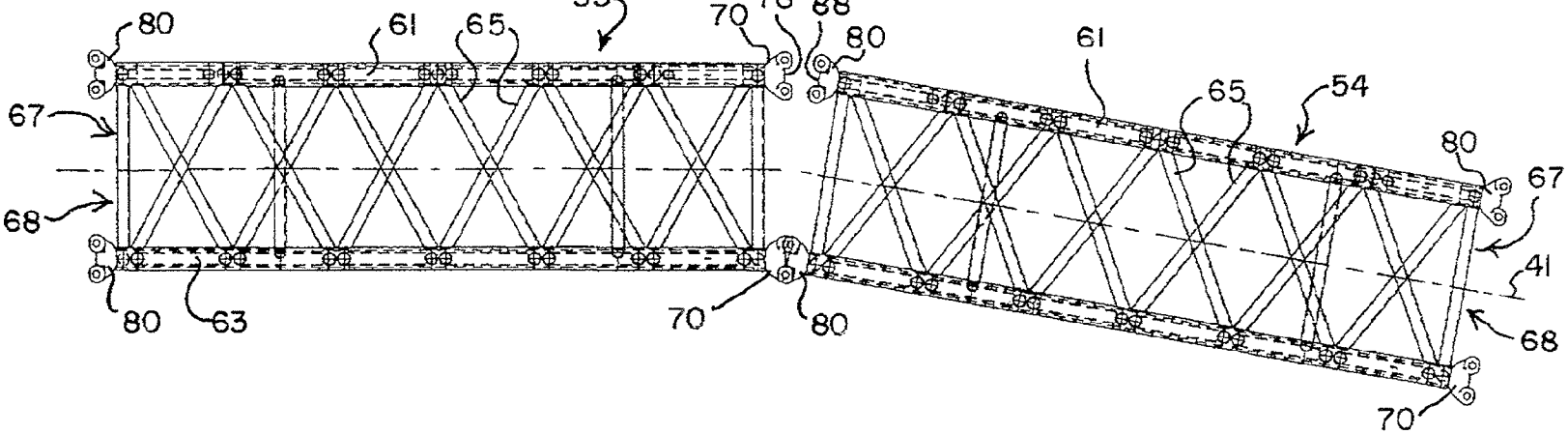
FIG. 3 is a side elevational view of the two boom segments of FIG. 2 being brought together from a second position to form the boom on the crane of FIG. 1.

As shown in FIG. 2, with the preferred boom segment connection system of the present invention, either the connectors on the top chords 61 can be connected first, or, as shown in FIG. 3, the connectors on the bottom chords 63 can be connected first, while the boom segments are in a non-aligned configuration. As explained in detail below, with the preferred connectors, the boom segments can then be pivoted and will automatically stop in a position where the additional connectors are aligned. It is also possible that the boom segments can be brought together with the longitudinal axes of the segments already lined up. In the preferred alignment system of the present invention, the configuration of the connectors facilitates such an alignment and coupling of the boom segments, also as explained in more detail below.

The connectors of the first embodiment are of two types, more precisely of two shapes, which may be referred to as first and second connectors, shown in detail in FIGS. 8-11. Each connector includes at least one extension having a through-hole there through sized to receive a main pin, the extensions extending away from the boom segments to which they are attached, and the through-hole having an axis perpendicular to that longitudinal axis. The extensions and through-holes are positioned on their respective connectors such that when the second end of the boom segment is in an aligned position with and coupled to the first end of an identical boom segment, with connectors on the two boom segments coupled together, the extensions of the coupled connectors overlap one another and the through-holes are aligned such that the main pin may be inserted through the through-holes to secure the connector of the second end of the boom segment to the connector of the first end of an identical boom segment. (It should be appreciated that while the connectors are discussed as connecting with connectors on identical boom segments, cranes utilizing the present invention do not need to use identical boom segments—this terminology is used just to help explain the connection process. Inventive boom segments used in the boom may differ in a number of respects, particularly in regard to features that have to do with crane assembly and operation other than the segment-to-segment connection system.) Preferably half of the connectors have a first number of extensions and half of the connectors have a second number of extensions, the second number being one greater than the first number, the connector on opposite ends of each chord having a different number of extensions from each other.

The connector on the first end of the chord of the first longitudinal portion of the boom segment includes a first alignment surface and a stop surface. The connector on the second end of the chord of the first longitudinal portion of the boom segment includes a second alignment surface and a stop surface. In this embodiment, these surfaces are provided by different structures on the connectors. In the second embodiment it will be seen that the same structure that provides an alignment surface can also provide the stop surface.

The first and second alignment surfaces cooperate such that when the first and second connectors are being brought together during boom assembly, the alignment surfaces guide the boom segments into a relative position such that the through-holes through the extensions in the connectors are aligned sufficiently such that a tapered main pin can be inserted through the through-holes of the extensions in the first and second mating connectors even if the boom segments are not axially aligned. The placement of the stop surface on the connectors are such that, when an identical boom segment is positioned such that a main pin can be inserted through the through-holes in the extensions of the connectors of the remainder of the chords on the second longitudinal portion of the boom segments, the stop surfaces cooperate to align the through-holes in the extensions of their respective connectors when the stop surfaces contact one another.

Figure 4:
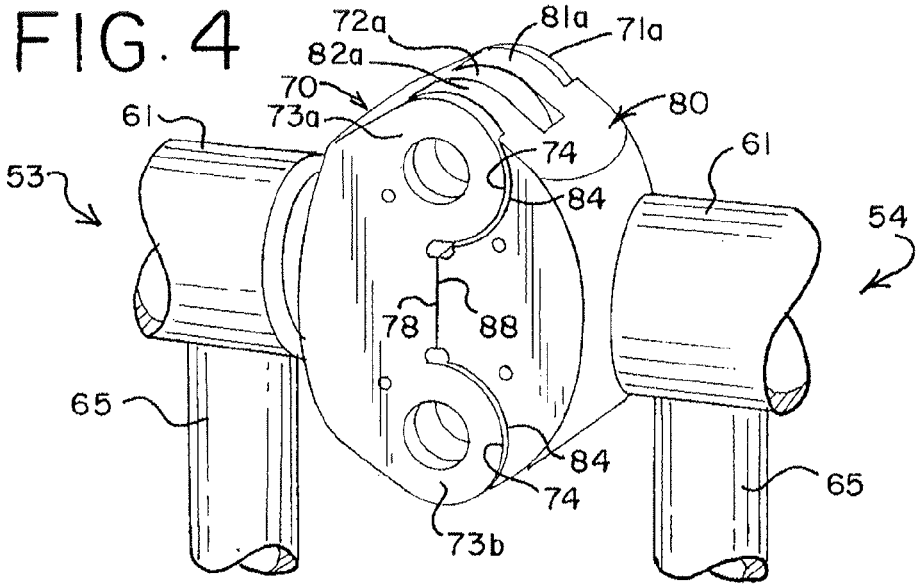
FIG. 4 is a perspective view of a mated pair of connectors used to connect the boom segments of FIG. 2.

FIG. 4 shows a mated connection between two sectional boom members 53 and 54. A first connecter 70 is affixed to the second end of a top chord 61 on a first sectional boom member 53. The connector 70 has two sets of three extensions 71*a*, 72*a*, and 73*a*, and 71*b*, 72*b* and 73*b* (best shown in FIG. 5), each having an aperture there through in the form of a through-hole. The connector 70 also includes a first alignment surface in the form of a rounded outer surfaces 74 on the distal ends of each extension. The connector 70 further comprises a generally flat, compressive load bearing surface 78 that extends across the width of the connector and separates the two sets of extensions. In this embodiment, the load bearing surface 78 provides the stop surface for the connector.

Figure 10:
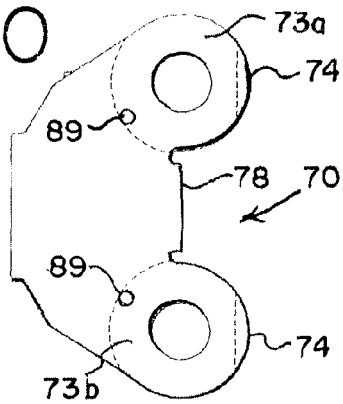
FIG. 10 is an enlarged side elevational view of the female connector of FIG. 8.
Figure 11:
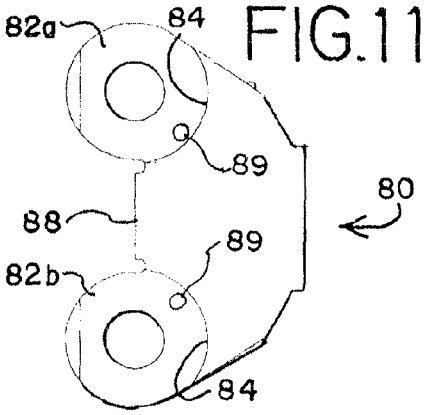
FIG. 11 is an enlarged side elevational view of the male connector of FIG. 9.

The second connector 80 is affixed to the first end of a top chord 61 on a second sectional boom member 54. The second connector 80 has two sets of two extensions 81*a* and 82*a*, and 81*b* and 82*b*, each having an aperture there through in the form of a through-hole. The extensions 71, 72 and 73 of each set on connector 70 are interleaved with the respective set of extensions 81 and 82 on connector 80 when the connectors are coupled together, as seen in FIG. 4. The connector 80 has second alignment surfaces in the form of pockets 84 adjacent the base of the outside portions of the extensions 81 and 82 matching the shape of the rounded outer surfaces 74. Drain holes 89 are provided in each connector 70, 80, as shown in FIGS. 10 and 11. The connector 80 also includes a generally flat, compressive load bearing surface 88 extending across the width of the connector. In this embodiment, the load bearing surfaces 78 and 88 provide the stop surfaces for the connector.

When a main pin (not shown in FIG. 4) is placed through the through-holes of the interleaved extensions 71*a*, 81*a*, 72*a*, 82*a* and 73*a*, securing the connectors 70 and 80 in a pivotal relationship, the second alignment surface surfaces 84 and rounded first alignment surfaces 74 are in close proximity but not quite in contact with one another when the boom segments are in axial alignment, as shown in FIG. 4. However, as shown in FIG. 2, when the boom sections 53 and 54 are not in axial alignment, the connectors 70 and 80 can still be coupled to one another. In that instance, the first alignment surfaces 74 and second alignment surfaces 84 will contact one another as the boom sections are brought close to one another. When they are in contact, the through-holes in the extensions 71, 72, 73, 81 and 82 are in close enough alignment that a tapered main pin (shown schematically in FIG. 5) may be inserted through the through-holes, meaning that it can start to be inserted, and the taper on the pin will cause the through-holes to fully align as the pin is driven through the through-holes.

Thereafter, when the boom segments are pivoted about this main pin, the compressive load bearing surface 78 will contact the compressive load bearing surface 88 to stop the pivoting at the point where the boom segments are aligned. Thus the stop surfaces are positioned such that if one set of first and second connectors are coupled together by a pin through their through-holes and the boom segments are in a non-aligned position, rotation of the boom segments about the pin through the through-holes of the coupled connectors to the point where the stop surfaces of the additional connectors on the boom segments contact one another will bring the boom segments into alignment and the through-holes on those additional connectors into alignment. After the segments 54 and 56 are in axial alignment, another pin may be placed through the second set of extensions 71*b*, 72*b*, 73*b*, 81*b* and 82*b*.

The bottom chords 63 are provided with connectors that have the same configuration as the connectors 70 and 80 on the top chords 61. The compressive load bearing surfaces of these lower connectors will come into contact with one another at the same time the compressive load bearing surfaces 78 and 88 on the top connectors come into contact with one another. The lower compressive load bearing surfaces thus also act as stop surfaces, aligning the through-holes in the lower connectors.

The connectors of the present invention allow sectional boom members to be connected and then rotate through a full 90° angle. Even if the boom segments are at an angle of 90° from their aligned position, first alignment surfaces 74 and second alignment surfaces 84 can be brought into contact with one another, making the through-holes through the extensions close enough in alignment that a pin may be inserted. Of course after the pin is fully inserted, second alignment surfaces 84 and surfaces 74 do not contact each other. This assures that all loads are carried through the surface to surface contact of the compressive load bearing surfaces 78 and 88. Any tension loads can be carried by the pins. The compressive load bearing surfaces are preferably symmetrical about the horizontal and vertical neutral axes of the chord to which they are attached.

When the boom segments are assembled from a non-aligned arrangement as shown in either of FIG. 2 or 3, the following steps will normally occur. The two boom segments will be brought together such that two connectors 70 on the first boom segment 53 mate with two respective connectors 80 on the second boom segment 54 to form two pairs of mated connectors, but the longitudinal axes 41 of the two segments are not aligned. The remaining connectors on each segment are not coupled. Next the mated connectors are fastened together with a pivoting connection as main pins are inserted though the through-holes on one side of both pairs of mated connectors. The two segments 53 and 54 are then pivoted with respect to each other about the pivoting connection until the compressive load bearing surface 78 contacts the compressive load bearing surface 88. This arrangement allows the boom sections to "back bend" about either the top or bottom boom connection. The boom sections can be rotatably engaged with either the top or bottom pins inserted, then pivoted to a position where the segments are aligned and the opposite connectors can be pinned and the other pin inserted through the through-holes on the inside of the top connectors.

The boom segments may also be brought together in a generally aligned position, where the connectors on the top and bottom chords contact each other at roughly the same time. It will be appreciated that with the preferred geometry of the connectors, if the boom sections are not exactly aligned as they come together, the first alignment surfaces 74 will engage the second alignment 84 and guide the connectors to slide relative to one another until the alignment surfaces 74 are fully seated in pockets 84, thus guiding the boom segments into the proper alignment such that when the engagement member and second alignment surface on both the upper and lower sets of connectors are fully engaged, the through-holes through the extensions in the connectors are aligned such that a main pin can be inserted through the through-holes of all extensions in the first and second mating connectors.

Figure 5:
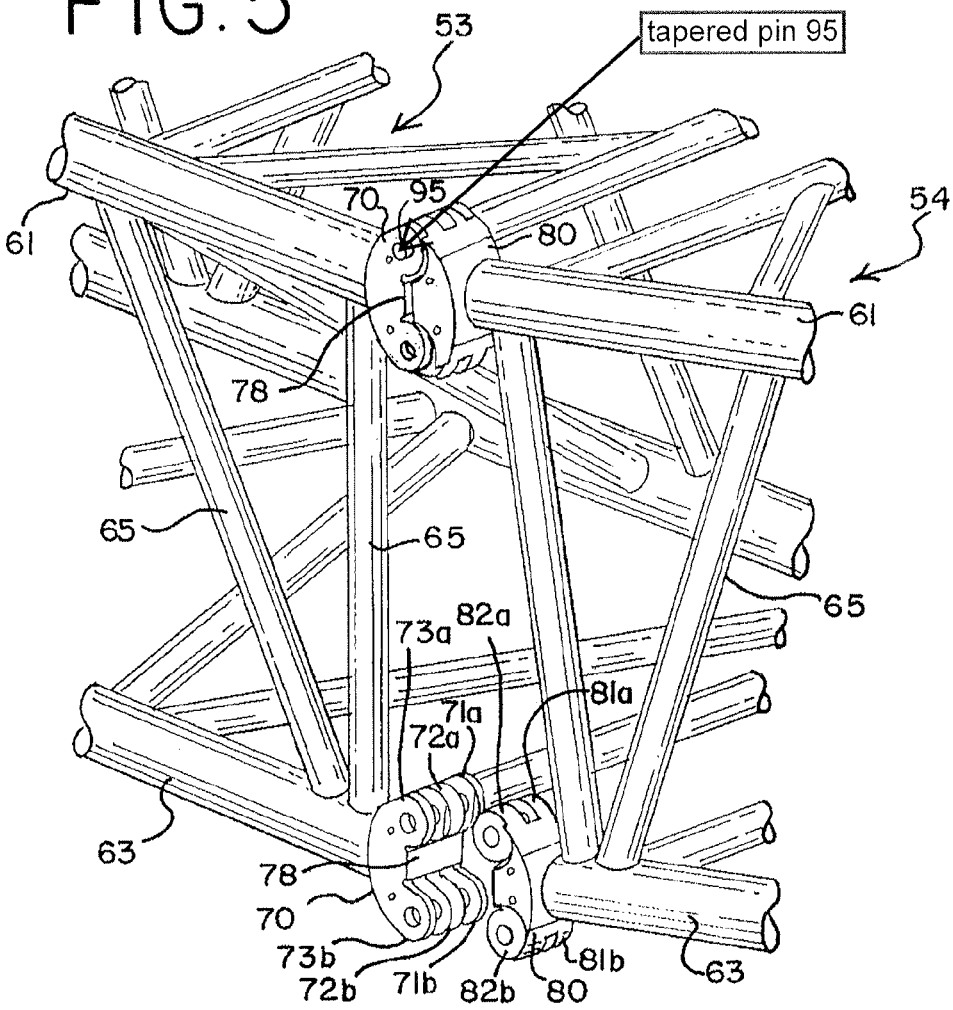
FIG. 5 is a perspective view of the ends of two boom segments of FIG. 2 being assembled.
Figure 5A:
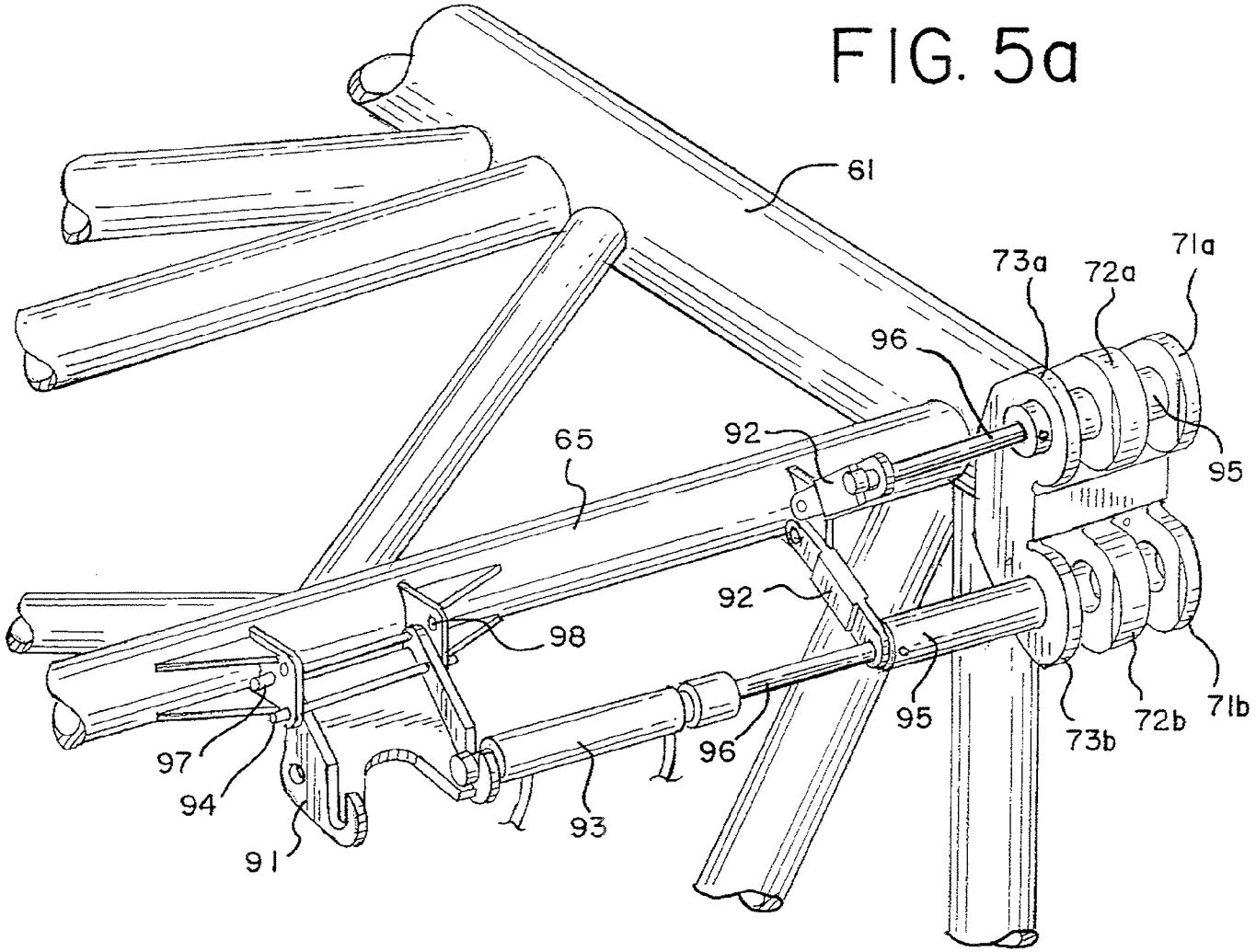
FIG. 5*a* is a top perspective view of one corner of a boom segment with a pin insertion and retraction device attached.
Figure 6:
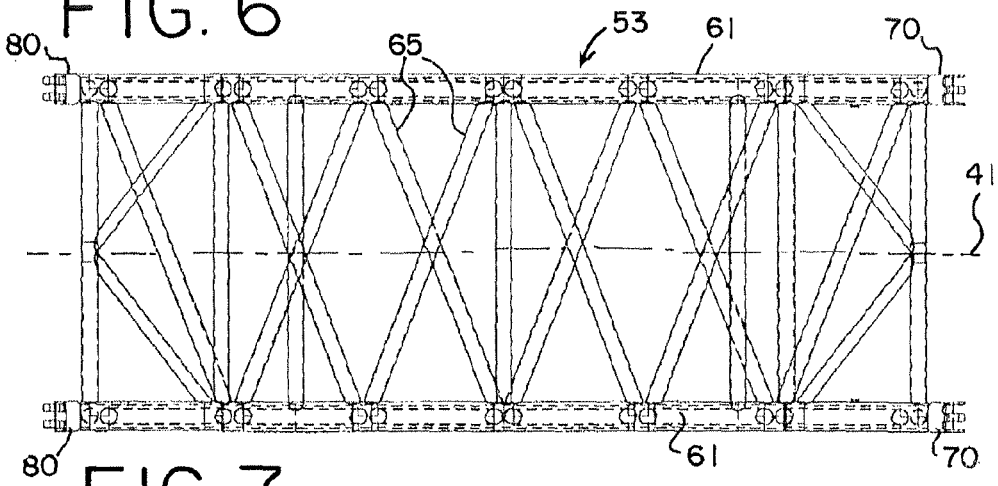
FIG. 6 is a top plan view of one of the boom segments of FIG. 2.
Figure 7:
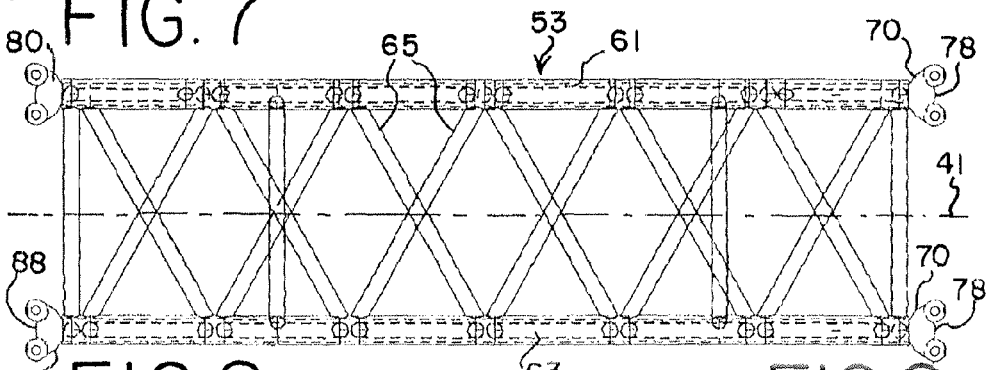
FIG. 7 is a side elevational view of one of the boom segments of FIG. 2.
Figure 8:
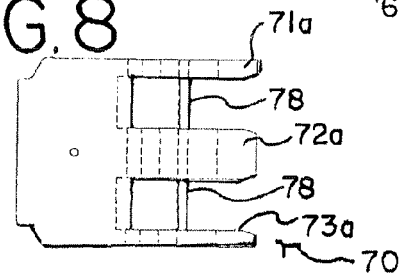
FIG. 8 is an enlarged top plan view of a female connector used on the boom segment of FIG. 6.
Figure 9:
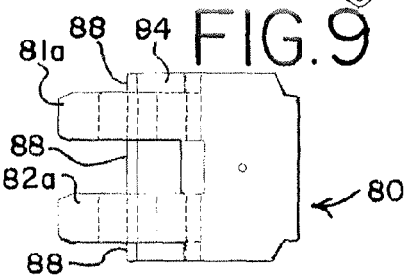
FIG. 9 is an enlarged top plan view of a male connector used on the boom segment of FIG. 6.

The boom segments preferably include brackets so that hydraulic pin insertion equipment can be mounted on the boom segment in a position to force the main pin through the through-holes. FIG. 5*a* shows one such configuration for a hydraulic pin inserter. Brackets 92 support the extensions 96 of pins 95 that are sized to fit in the through-holes in the extensions 71, 72, 73, 81 and 82. Another bracket 91 is connected to the center of the top lacing element 65 that spans between the ends of top chords 61. A hydraulic pin insertion/retraction tool 93 with a double acting hydraulic cylinder can fit into one side of bracket 91 and connect to the extension 96 of the pin 95. Once the lower pins have been inserted, pin 94 is removed, allowing bracket 91 to pivot about pin 97 into an upper position. Pin 94 is then inserted through holes 98 and the tool 93 can be put back into the bracket 91 and connected to the extension 96 of the upper pin 95. Retraction of the pins is carried out in a reverse operation.

A second embodiment of the invention is shown in FIGS. 12-21. Many of the elements in the second embodiment are just like the elements in the first embodiment. Reference numbers for these items that are identical between the two embodiments are the same with an addend of 100. For example, the boom segments 152 and 154 have chords 161 and 163 and lacing elements 165. The preferred connectors for this embodiment are also of two types, more precisely of two shapes, which may be referred to as first and second connectors, shown in detail in FIGS. 18-21.

FIG. 14 shows a mated connection between two sectional boom members 153 and 154. A first connecter 170 is affixed to the second end of a top chord 161 on a first sectional boom member 153. The connector 170 has three extensions 171, 172, 173, each having a through-hole there through. The connector 170 also includes an engagement member in the form of a guide pin 174 captured in an additional through-hole though the extensions 171-173. The engagement member extends from the outer extensions 171 and 173, generally parallel to the axis of the through-holes in the extensions of the connector 170. The engagement member provides both an alignment surface and a stop surface.

The second connector 180 is affixed to the first end of a top chord 161 on a second sectional boom member 154. The second connector 180 has two extensions 181 and 182, each having a through-hole there through. The extensions 171, 172 and 173 are interleaved with the extensions 181 and 182 when the connectors are mated. The connector 180 has a second alignment surface, in the form of a pin seat 184 matching the outer circumference of the guide pin 174, formed on the outside of the extensions 181 and 182. As shown in FIGS. 14 and 15, the surface of the pin seat 184 that engages the guide pin 174 faces away from the column segment to which it is attached. Unlike the alignment surfaces of the connectors 70 and 80, the alignment surfaces on connectors 170 and 180 are not concentric with the axis of the pin used to pin the engaged connectors together. However, first and second alignment surfaces allow the connectors 170 and 180 to be brought into a close enough alignment such that a main pin (not shown) can be placed through the through-holes of the interleaved extensions, securing the connectors 170 and 180 in a pivotal relationship, as shown in FIG. 14. When this happens, the second alignment surface 184 and the guide pin 174 loose contact with one another for a slight distance when the boom segments are in axial alignment.

Figure 12:
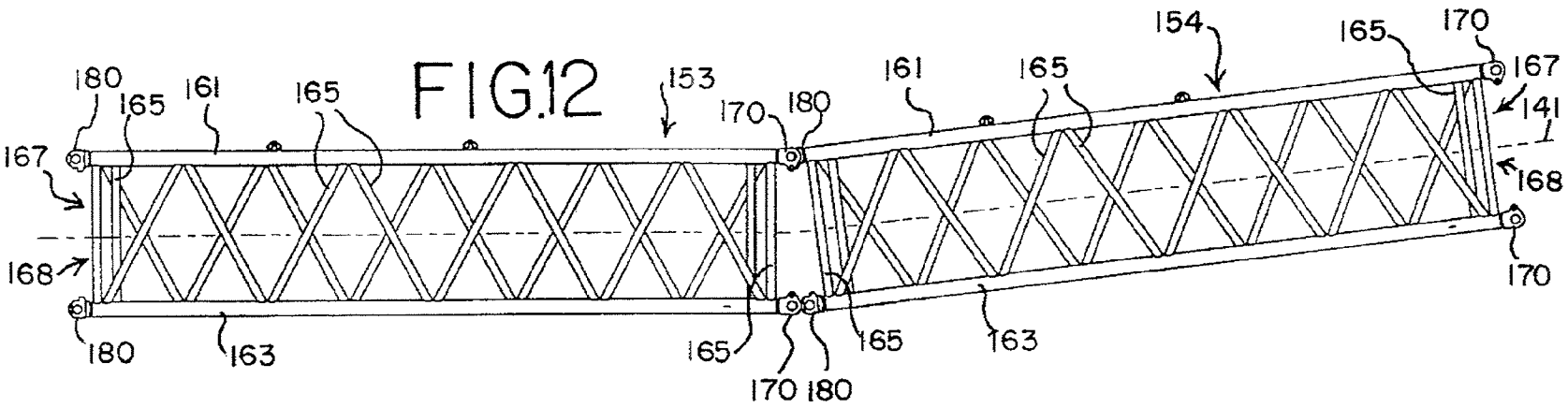
FIG. 12 is a side elevational view of two boom segments of a second embodiment being brought together from a first position to form the boom on the crane of FIG. 1.
Figure 13:
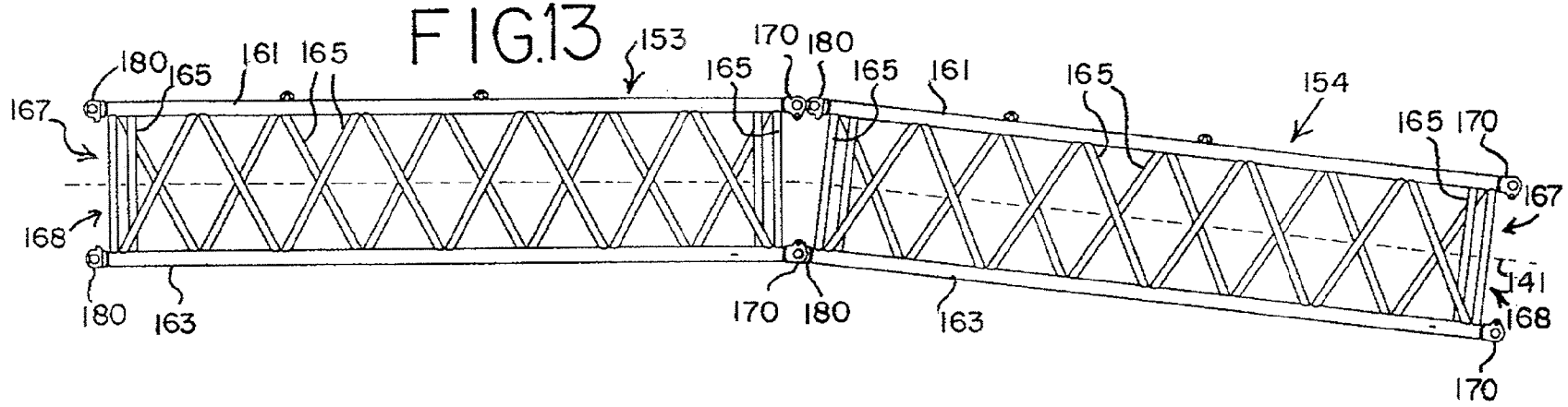
FIG. 13 is a side elevational view of the two boom segments of FIG. 12 being brought together from a second position to form the boom on the crane of FIG. 1.
Figure 16:
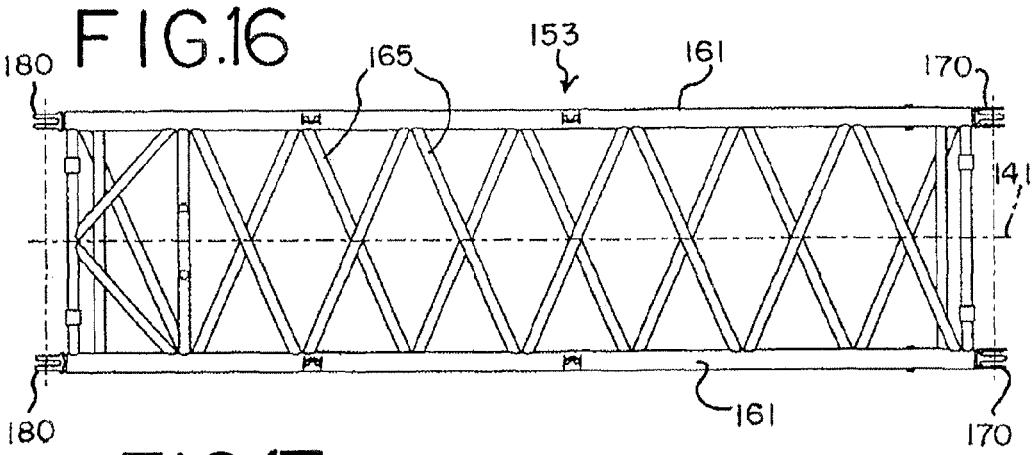
FIG. 16 is a top plan view of one of the boom segments of FIG. 12.
Figure 17:
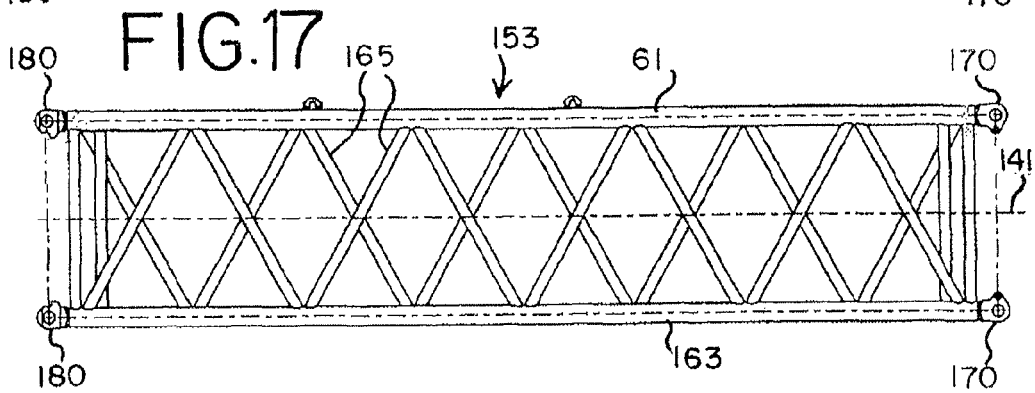
FIG. 17 is a side elevational view of one of the boom segments of FIG. 12.
Figure 18:
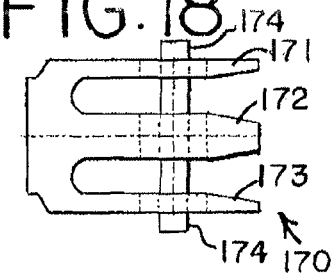
FIG. 18 is an enlarged top plan view of a female connector used on the boom segment of FIG. 16.
Figure 19:
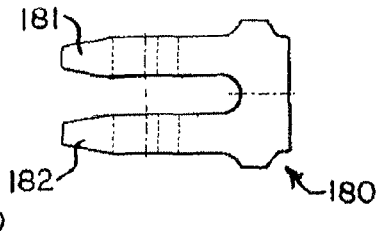
FIG. 19 is an enlarged top plan view of a male connector used on the boom segment of FIG. 16.
Figure 20:
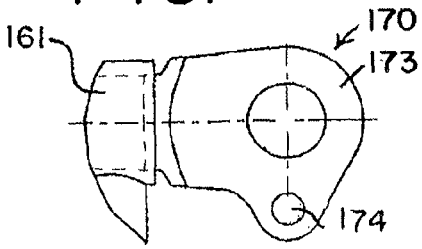
FIG. 20 is an enlarged side elevational view of the female connector of FIG. 18.
Figure 21:
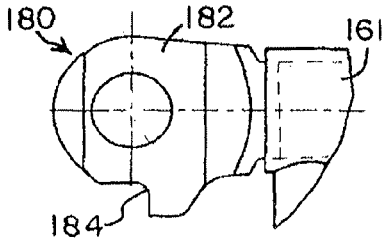
FIG. 21 is an enlarged side elevational view of the male connector of FIG. 19.

As shown in FIG. 12, when the boom sections 153 and 154 are not in axial alignment, the connectors 170 and 180 can still be coupled to one another and the main pin inserted through the through-holes in the extensions 171, 172, 173, 181 and 182, although the pin seat 184 and guide pin 174 will not contact each other in such a situation. Thereafter, when the boom segments are pivoted about the main pin, the second alignment surface 184 on the other connector will contact the guide pin 174 to stop the pivoting at the point where the boom segments are aligned. Alternatively, instead of inserting the main pin when the boom sections 153 and 154 are not in axial alignment as shown in FIG. 12, with the guide pin 174 engaged with the pin seat 184, the segments 153 and 154 may be rotated about the axis of the guide pin 184 until the second alignment surface 184 on the lower connector contacts the guide pin 174 to stop the pivoting at the point where the boom segments are aligned. In this way, the same structure that provides alignment surfaces (guide pin 174 and pin seat 184) in one set of connectors provides stop surfaces in the other connectors on the boom segment.

The bottom chords 163 are provided with connectors that have the same configuration as the connectors 170 and 180 on the top chords 161, but the connectors are installed in mirror image fashion, as shown in FIG. 15. The first alignment surfaces 174 and second alignment surfaces 184 on the connectors of the top chords 161 are on opposite sides of the connectors compared to the first alignment surfaces 174 and second alignment surfaces 184 on the connectors of the bottom chords. Thus the first and second alignment surfaces on the connectors are on surfaces of the connectors that face toward the longitudinal portion of the segment to which they are not attached. The first alignment surfaces and second alignment surfaces on the connectors of the top chords face the bottom chords, and the first alignment surfaces and second alignment surfaces on the connectors of the bottom chords face the top chords.

The connectors of the second embodiment also allow sectional boom members to be connected and then rotate through a full 90° angle. Even if the boom segments are at an angle of 90° from their aligned position, the through-holes through the extensions can be lined up and a pin inserted. Of course in this position the first and second alignment surfaces do not contact each other. When the boom segments are assembled from a non-aligned arrangement as shown in either of FIG. 12 or 13, the following steps will normally occur. The two boom segments will be brought together such that two connectors 170 on the first boom segment 153 mate with two respective connectors 180 on the second boom segment 154 to form two pairs of mated connectors, but the longitudinal axes 141 of the two segments are not aligned. The remaining connectors on each segment are not coupled. Next the mated connectors are fastened together with a pivoting connection as main pins are inserted though the through-holes of both pairs of mated connectors. The two segments 153 and 154 are then pivoted with respect to each other about the pivoting connection until the first alignment surface on the non-coupled connectors of the first segment 153 contacts the second alignment surfaces on the non-coupled connectors of the second segment 154. The previously non-coupled connectors are then pinned to their respective mating connector. This arrangement allows the boom sections to "back bend" about either the top or bottom boom connection. The boom sections can be rotatably engaged with either the top or bottom pins inserted, and then pivoted to a position where the segments are aligned and the opposite connectors can be pinned.

The boom segments may also be brought together in a generally aligned position, where the connectors on the top and bottom chords contact each other at roughly the same time. It will be appreciated that with the preferred geometry of the connectors, if the boom sections are not exactly aligned as they come together, the radius on the outside of extensions 181 and 182 will engage the pin 174 and force the connectors to slide around the pin 174, thus urging the boom segments into the proper alignment such that when the engagement member and second alignment surface on both the upper and lower sets of connectors are fully engaged, the through-holes through the extensions in the connectors are aligned such that a main pin can be inserted through the through-holes of all extensions in the first and second mating connectors.

With the second embodiment of the present invention, compressive loads on the boom generate shear forces in the main pin holding the first and second connectors together. The compressive loads are carried by four shear surfaces in each of the main pins, which allows the diameter of those pins to be reduced compared to a system with only a double shear connection.

One of the benefits of either embodiment is that common castings can be used to make all four connectors on the same end of the boom segment, which simplifies manufacturing. In the preferred manufacturing process, the castings are pre-machined and then welded to the chord members. The chord members are then assembled into a boom segment, and then final machining on the connectors is performed. This procedure allows the final configuration of the connectors to be made without having to worry about distortion due to welding and machining of the large boom sections.

Besides the preferred embodiment of the invention depicted in the figures, there are other embodiments contemplated. For example, the figures show all four of the connectors having the same number of extensions on a given end of a boom segment. However, connectors 70 could be used on the top chords and connectors 80 used on the bottom chords at one end of a segment, with connectors 80 being on the top chords and connectors 70 being on the bottom chords on the opposite end of the segment. When two segments were brought together, the same non-aligned and aligned joining operations could be used.

Another advantage of the present invention is particularly useful for very high capacity booms. While the connectors are primarily designed for large compressive loads, there may be times when the connectors need to be able to handle tension loads across the connections. The pins through the through-holes are able to handle these tension loads.

It should be appreciated that the apparatus of the present invention is capable of being incorporated in the form of a variety of embodiments, only a few of which have been illustrated and described above. The invention may be embodied in other forms without departing from its spirit or essential characteristics. For example, while boom segments with four chords have been described, the invention can also be used with boom segments that have three chords, or that have more than four chords. Instead of both the top and bottom connectors having the engagement member and second alignment surface, these could be used on just one set of the connectors, and the other connectors have just a simple connector as know in the prior art. The described embodiments are to be considered in all respects only as illustrative and not restrictive, and the scope of the invention is therefore indicated by the appended claims rather than by the foregoing description. All changes which come within the meaning and range of equivalency of the claims are to be embraced within their scope.

The invention claimed is:

1. A crane having an upper works rotatably mounted on a lower works, the upper works including at least one column, the column comprising:

a) at least a first and second column segment each with a longitudinal axis and a first and second end, the second end of the first segment being coupled to the first end of the second segment;

b) at least one first connector on the second end of the first segment configured to respectively mate with at least one second connector on the first end of the second segment;

c) the first and second connectors each comprising at least one extension having a through-hole there through, and the through-hole having an axis perpendicular to said longitudinal axis and positioned in the extensions such that all through-holes of mated first and second connectors are aligned when the column segments are aligned;

d) the at least one first connector comprising a first alignment surface comprising a rounded outer surface on a distal end of the extension of the first connector, and the at least one second connector comprising a second alignment surface comprising a concave pocket adjacent a base of the extension on the second connector; and e) the first and second alignment surfaces configured to cooperate such that when the first and second connectors are being brought together during column assembly, said alignment surfaces guide the column segments in two dimensions within a plane transverse to the axis of the through-holes through the connectors into a relative position such that when the first and second alignment surfaces on both the first and second connectors are fully engaged, the through-holes through the extensions in the connectors are aligned such that a tapered main pin can be inserted through the through-holes of all extensions in the first and second mating connectors.

2. The crane of claim 1 wherein said alignment surfaces are configured to guide the column segments in two dimensions within a plane transverse to the axis of the through-holes through the connectors into a relative position such that the through-holes through the extensions in the connectors are aligned sufficiently such that the tapered main pin can be inserted through the through-holes of the extensions in the first and second mating connectors even if the column segments are not axially aligned.

3. The crane of claim 1 wherein the first and second column segments each further comprise additional connectors, and the additional connectors each comprise a stop surface, the stop surfaces being positioned such that if the first and second connectors are coupled together by a pin through their through-holes and the column segments are in a non-aligned position, rotation of the column segments about the pin through the through-holes of the coupled connectors to the point where the stop surfaces of the additional connectors on the column segments contact one another will bring the column segments into alignment and the through-holes on those additional connectors into alignment.

4. The crane of claim 1 wherein when the tapered pin is fully inserted through the through-holes, the first and second alignment surfaces are not in contact with one another.

5. The crane of claim 1 wherein the first connector comprises three extensions and the second connector comprises two extensions, each extension of the second connector fitting between extensions on the first connector when the column members are connected in their operational position.

6. The crane of claim 1 wherein compressive loads on the column generate shear forces in the main pin holding the first and second connectors together, and the compressive loads are carried by four shear surfaces in each of the main pins.

7. The crane of claim 1 wherein the first and second column segments each comprise four chords with intermediate lacing elements there between, each of the chords having first and second ends corresponding to the first and second ends of the column segments.

8. The crane of claim 7 wherein two of said four chords comprise top chords and the other two of said four chords comprise bottom chords when the crane is in an operational mode, and each of the four chords has a first connector at a first end and a second connector at a second end.

9. The crane of claim 1 wherein the column comprises a boom.

10. A mated connection between two sectional column members comprising:

a) a first connecter affixed to an end of a first sectional column member and a second connector affixed to an end of a second sectional column member;

b) each first and second connector having at least one extension, with each extension having a through-hole there through sized to receive a pin;

c) the pin passing through the through-hole of each extension of the first connector and the through-hole of each extension of the second connector, and d) wherein the extension on the first connector comprises a rounded first alignment surfaces on a distal end of the extension; and the second connector comprises a pocket adjacent a base of the extension on the second connector that provides a second alignment surface, the first and second alignment surfaces being configured such that the first connector and the second connector can be brought together from an angled relationship and the first and second alignment surfaces cooperate to guide the first connector and the second connector in two dimensions within a plane transverse to the axis of the through-hole through the first connector and the second into a relative position so as to align the through hole in the at least one extension on the first connector with the through hole of the at least one extension on the second connector sufficiently that the pin can be inserted through each through hole.

11. The mated connection between two sectional column members of claim 10 wherein the first connector comprises three extensions and the second connector comprises two extensions.

12. A crane column segment comprising:

a) at least three chords, with interlacing elements connecting the chords into a fixed, parallel relationship forming a column segment; each of the chords, and the column segment, having a first end and a second end; at least one of the at least three chords being present in a first longitudinal portion of the column segment and the remainder of the at least three chords being present in a second longitudinal portion of the column segment;

b) a connector on each of the first and second ends of each of the chords; half of all of the connectors on the column segment being of a first type and having at least one extension and half of all of the connectors on the column segment being of a second type and having at least one extension; and c) the extensions having a through-hole there through sized to receive a main pin, the extensions and through-holes being positioned on their respective connectors such that when the second end of the column segment is in an aligned position with and coupled to the first end of an identical column segment, with connectors on the two column segments coupled together, the extensions of the coupled connectors overlap one another and the through-holes are aligned such that the main pins may be inserted through the through-holes to secure the connector of the second end of the column segment to the connector of the first end of the identical column segment; the first type of connectors comprising a first alignment surface comprising a rounded outer surface on a distal end of the extension of the first type of connector and the second type of connector comprising a second alignment surface comprising a pocket adjacent a base of the extension on the second type of connector, wherein said first alignment surface and second alignment surface cooperate to guide the column segment relative to the identical column segment in two dimensions within a plane transverse to the axis of the through-holes through the connector of the second end of the column segment and the connector of the first end of the identical column segment.

13. The crane column segment of claim 12 wherein the connectors on opposite ends of each chord have a different number of extensions from each other.

14. The crane column segment of claim 12 wherein the first type of connectors have three extensions and the second type of the connectors have two extensions.

15. The crane column segment of claim 12 wherein the first type of connector is present on the first end of the at least one chord of the first longitudinal portion of the column segment, and the second type of connector is present on the second end of the at least one chord of the first longitudinal portion of the column segment, and the alignment surfaces cooperate such that when the first and second connectors of identical column segments are being brought together during column assembly, said alignment surfaces guide the column segments in two dimensions within a plane transverse to the axis of the through-holes through the connectors into a relative position such that the through-holes through the extensions in the connectors are aligned sufficiently such that the main pin can be inserted through the through-holes of the extensions in the first and second mating connectors even if the column segments are not axially aligned.

16. A method of connecting first and second segments of a lift crane column, the column segments each comprising a longitudinal axis, two top chords and two bottom chords, with each of the chords having a connector on each end thereof, each connector comprising at least one extension having a through-hole there through, and the through-hole having an axis perpendicular to said longitudinal axis and positioned in the extensions such that all through-holes of mating connectors are aligned when the column segments are aligned; with at least one first connector on one of the ends of the chords of the first segment comprising a first alignment surface comprising a rounded outer surface on a distal end of the extension of the first connector, and at least one second connector on one of the ends of the chords of the second segment comprising a second alignment surface comprising a concave pocket adjacent a base of the extension on the second connector, the method comprising:

a) bringing the two column segments together such that the first alignment surface contacts the second alignment surface to form a pair of engaged connectors, the first and second alignment surfaces cooperating to guide the first and second column segments in two dimensions within a plane transverse to the axis of the through-holes through the extensions into a relative position to generally align the through-holes in the first and second connectors even if the longitudinal axes of the two segments are not aligned and the remaining connectors on each segment are not coupled;

b) placing a tapered pin through the through-holes of the extensions of the first and second connectors, providing a pivoting connection;

c) pivoting the two segments with respect to each other about the pivoting connection until a stop surface on the non-coupled connectors of the first segment contacts a stop surface on the non-coupled connectors of the second segment; and d) pinning the previously non-coupled connectors to their respective mating connector.

17. The method of claim 16 wherein each of the first connectors comprises at three extensions and the second connector comprises two extensions.

18. The method of claim 16 wherein when the tapered pin is fully inserted through the through-holes, the first and second alignment surfaces are not in contact with one another.

19. The method of claim 16 in which each of the connectors on each of the chords comprise alignment surfaces, and wherein the segments are brought together in a generally aligned position, where the connectors on the top and bottom chords contact each other at roughly the same time, and if the segments are not exactly aligned as they come together, the alignment surfaces will engage each other and guide the connectors to slide relative to one another until each rounded outer distal end alignment surface is fully seated in the pocket, thus guiding the segments into the proper alignment.

* * * * *